United States Patent [19]

Lee

[11] 4,004,120

[45] Jan. 18, 1977

[54] SWITCH BEZEL WITH VISUAL INDICATOR

[75] Inventor: Ivan A. Lee, E. Weymouth, Mass.

[73] Assignee: C & K Components, Inc., Watertown, Mass.

[22] Filed: July 17, 1975

[21] Appl. No.: 596,598

[52] U.S. Cl. ..... 200/310; 240/152

[51] Int. Cl.[2] ..... H01H 9/00

[58] Field of Search ..... 200/310, 314, 315; 240/152

[56] References Cited

UNITED STATES PATENTS

| | | | |
|---|---|---|---|
| 973,568 | 10/1910 | Russell | 240/152 X |
| 2,420,000 | 5/1947 | Linton | 240/152 X |

*Primary Examiner*—Herman Hohauser
*Attorney, Agent, or Firm*—Weingarten, Maxham & Schurgin

[57] ABSTRACT

A switch bezel with a visual indicator mounted thereto. The bezel accommodates a snap-in switch and a snap-in indicator, the combination of which then snaps into an opening in a panel. The indicator may operate completely independently from the switch or may indicate some function cooperative with the switching action of the switch.

5 Claims, 5 Drawing Figures

SWITCH BEZEL WITH VISUAL INDICATOR

FIELD OF THE INVENTION

This invention relates generally to switches and more particularly concerns a bezel for a switch having provision for a visual indicator mounted in the bezel.

DISCUSSION OF THE PRIOR ART

Bezels for mounting a switch to a panel have previously been used for many types of switches including pushbutton, rocker, toggle and paddle handle, among others. It has also been common to provide the hand actuated switching element, such as the pushbutton, to be made of luminescent material so that the button itself can be illuminated as desired to indicate the status of the switch. Additionally, switches with light emitting diodes (LED's) mounted directly in the actuating element or pushbutton of the switch so as to illuminate a small portion of the center thereof have also been available. An example of the prior art is U.S. Pat. No. 3,849,621.

Substantially all of the prior art devices employing lighted switch-actuating elements have coupled the visual indication to the status of the switch and it usually is a part of the switch actuating element itself.

SUMMARY OF THE INVENTION

This invention generally concerns a switch bezel having a visual indicator mounted thereto separately from the switch actuating element and more particularly concerns a light emitting diode (LED) indicator bezel for use with a snap-in switch. The bezel is configured to accommodate an LED in such a manner that the LED can be snapped into the bezel without the need for any additional paraphernalia to secure the LED therein. The bezel is otherwise configured to receive a conventional snap-in switch assembly wherein the switch assembly also has means to secure it within the opening previously prepared in a panel. The indicator could be any alpha-numeric display or modular device, and it may be electrical, electro-mechanical, vacuum, pneumatic or any type which may be actuated by a simple electrical signal or pulse. The term "light emitting diode" (LED) wll be used herein as an example and to encompass the various indication devices which could be used in this assembly. Alternative embodiments are disclosed wherein a bezel configured for a single switch assembly may be configured for two or more LED indicators and a multiple switch assembly bezel may also be configured for multiple LED indicators.

BRIEF DESCRIPTION OF THE DRAWING

The advantages, features and objects of this invention will be more clearly understood from the following detailed description when taken in conjunction with the drawing in which.

DESCRIPTION OF THE PREFERRED EMBODIMENT

Figure 1:
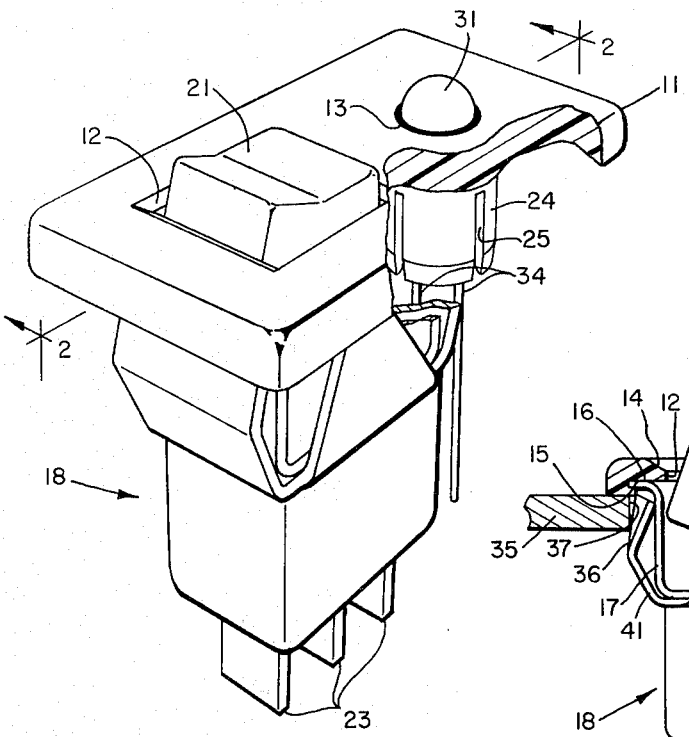
FIG. 1 is a partially cut away perspective view of the bezel of this invention together with an LED and a rocker switch.
Figure 2:
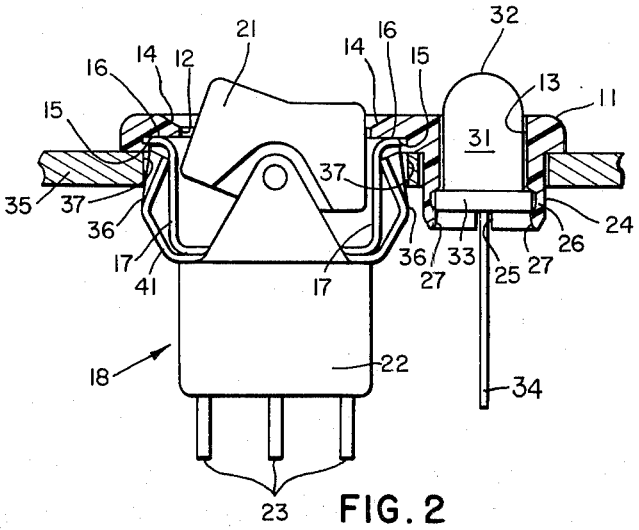
FIG. 2 is a sectional view of the bezel and switch assembly of FIG. 1 taken through cutting plane 2—2, and is shown mounted to a panel.

With reference now to the drawing and more particularly to FIGS. 1 and 2 thereof, there is shown bezel 11 having a generally rectangular configuration with a rectangular switch opening 12 adjacent one end thereof and a circular indicator opening 13 adjacent the other end. Opening 12 has bevels 14 on two opposite sides, the other two sides being straight and substantially perpendicular to the upper surface of the bezel. Below bevels 14 are undercut slots 15 adapted to receive flanges 16 of generally Z-shaped brackets 17 of switch assembly 18. Rocker button 21, the switch actuating element, protrudes through opening 12 in the bezel for manual operation of the switch. The switch itself is contained within rectangular block 22 and switch contact leads 23 protrude from the bottom thereof.

Projecting downwardly from hole 13 through the bezel and surrounding and acting as an extension of the hole are arcuate fingers 24, each separated by a slot 25. Preferably there are three or four such fingers projecting downwardly from the bottom side of the bezel. The interior surface of each finger 24 is configured adjacent its distal end by an arcuate depression 26 and a beveled surface 27 immediately adjacent the arcuate surface and at the distal end of fingers 24. LED 31 is formed with a dome 32 and an annular bottom flange 33 projecting radially from the cylindrical surface below the dome. Electrical leads 34 project downwardly from the bottom of the LED. The dome and cylinder of the LED fit closely within hole 13 in the bezel while annular flange 33 provides an interference fit at the opening defined by fingers 24. Through the means of separate fingers 24, a desired amount of flexibility is attained to permit the LED to be forced upward in opening 13 so that flange 33 snaps past bevels 27 and is securely seated within arcuate depressions 26 in the inner surfaces of the fingers.

When the bezel, LED and the switch are mounted together as a composite assembly, they may be inserted into a panel 35 from the front thereof. Spring brackets 36 project outwardly on opposite sides of switch assembly 18 beyond Z-shaped brackets 17 and provide an interference fit with opening 37 through panel 35. Angled surfaces 41 of spring brackets 36 operate as a bevel thereby permitting these retaining brackets to be forced through opening 37. Bezel 11 is larger than opening 37 in panel 35 and when the bottom surfaces of the bezel engagingly confront the top surface of the panel, retaining brackets 36 provide firm engagement with the interior edges of opening 37 in the panel thereby retaining the bezel, LED and switch assembly securely mounted to the panel.

Figure 3:
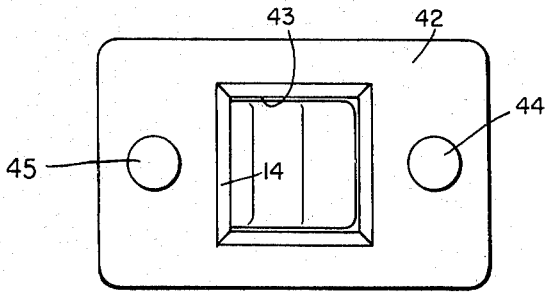
FIG. 3 is a plan view of a bezel of an alternate embodiment of this invention configured to accommodate two LED's.
Figure 4:
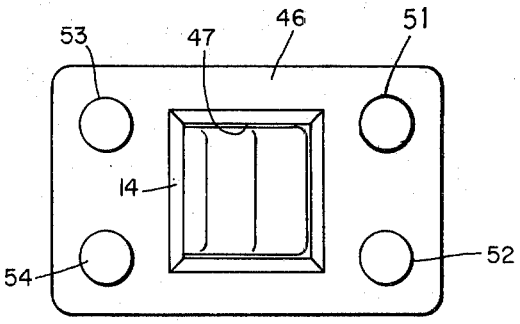
FIG. 4 is a plan view of a bezel of another embodiment of this invention configured to accommodate four LED's.

FIG. 3 shows a bezel 42 having a rectangular opening 43 therein for a switch assembly and holes 44 and 45 for led indicators. The structure of the bezel of FIG. 3 is substantially the same as that of FIGS. 1 and 2, with the addition of a second LED hole. In FIG. 4 bezel 46 is configured with opening 47 for the switch assembly, and led holes 51, 52, 53 and 54. Except for the addition of two more LED holes, bezel 46 does not differ from that previously discussed.

Figure 5:
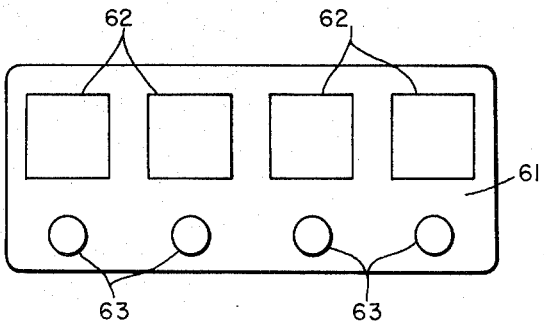
FIG. 5 depicts a plan view of still another alternate embodiment of this invention with multiple switches and multiples LED's.

Another alternative embodiment is shown in FIG. 5 wherein a ganged bezel 61, having the same properties as single unit bezel 11 of FIG. 1, is configured with four switches 62 and four LED's 63. Of course, other combinations of switches and indicators could be formed as desired.

The function of the LED of this invention need not have any relationship to the status of the switch mounted to the bezel. The indicator could be a warning signal, a status signal, or a signal to indicate that a certain function is occurring or should be commenced, as examples. On the other hand, the LED could indicate the status of the switch if desired or it could indicate that the time to actuate the switch has occurred within a system to which both the LED and the switch are connected. The switch itself may not only have any of the several actuators previously mentioned but it may be any type of switch such as single-pole double-throw, double-pole double-throw, single-pole single-throw, pushbutton and many other types. While the LED is shown as a snap-in device, it could be secured to the bezel by means of epoxy or otherwise attached. Also the switch and LED openings in the bezel may have any desired shape to accommodate the element to be secured therein.

In view to the above description, it is likely that modifications and improvements will occur to those skilled in the art which are within the scope of this invention.

What is claimed is:

1. A switch assembly adapted to be mounted to a panel, said switch assembly comprising:

a generally rectangular bezel having a top surface, a bottom surface, at least one switch opening and at least one indicator hole therethrough spaced from said switch opening, said bezel including a pair of lateral undercut slots adjacent said bottom surface on opposite sides of said switch opening and a plurality of flexible fingers arcuate in transverse shape and projecting downwardly from said bezel, surrounding and rearwardly extending said indicator hole thereby forming a receptacle, said fingers having arcuate depressions on their inner surfaces separated from the distal ends thereof by inwardly beveled surfaces;

a switch having opposed outwardly projecting bracket members engaging said lateral slots whereby said switch is removably mounted to said bezel, said switch having an actuator element projecting upwardly through said switch opening; and a generally cylindrical visual indicator device having a radially projecting annular flange formed at the bottom end thereof, said indicator device being mounted in said indicator hole with said flange seated within said arcuate depressions in said fingers, the top of said indicator projecting upwardly through said indicator hole;

said switch assembly being adapted to be mounted to said panel, said panel having openings therein configured to align with said switch opening and said indicator hole through said bezel, whereby said bezel is positioned on the front of said panel, said switch and said visual indicator project rearwardly through respective said openings in said panel.

2. A switch assembly adapted to be mounted to a panel, said switch assembly comprising:

a generally rectangular bezel having a top surface, a bottom surface, at least one switch opening and at least one indicator hole therethrough spaced from said switch opening, said bezel including a pair of lateral undercut slots adjacent said bottom surface on opposite sides of said switch opening and a plurality of fingers arcuate in transverse shape and projecting downwardly from said bezel, surrounding and rearwardly extending said indicator hole thereby forming a receptacle;

a switch having opposed outwardly projecting bracket members engaging said lateral slots whereby said switch is removably mounted to said bezel, said switch having an actuator element projecting upwardly through said switch opening; and a visual indicator device mounted in said receptacle and being visible through said indicator hole;

said switch assembly being adapted to be mounted to said panel, said panel having openings therein configured to align with said switch opening and said indicator hole through said bezel, whereby said bezel is positioned on the front of said panel, said switch and said visual indicator project rearwardly through respective said openings in said panel.

3. The switch assembly recited in claim 2 wherein:

said fingers are flexible, their proximate end being connected to said bezel and having arcuate depressions on their inner surfaces separated from the distal ends thereof by inwardly beveled surfaces; and said visual indicator is generally cylindrical in shape and is formed with a radially projecting annular flange formed at the bottom end thereof, said flange being seated within said arcuate depressions in said fingers, the top of said indicator being dome-shaped and projecting upwardly through said indicator hole.

4. The switch assembly recited in claim 2 wherein:

said bezel is formed with a plurality of said indicator holes; and one of said visual indicators is mounted in each of said indicator holes.

5. The switch assembly recited in claim 4 wherein:

said bezel is formed with plurality of said switch openings; and one of said switches is mounted in each of said indicator holes.

* * * * *